US007105477B2

(12) United States Patent
Takiguchi et al.

(10) Patent No.: US 7,105,477 B2
(45) Date of Patent: Sep. 12, 2006

(54) LIQUID DETERGENT COMPOSITION COMPRISING A POLYMER HAVING A CARBOXYL GROUP AND AN ALKYLENEOXY GROUP

(75) Inventors: Osamu Takiguchi, Wakayama (JP); Koji Yui, Wakayama (JP); Takashi Oda, Wakayama (JP)

(73) Assignee: Kao Corporation, Tokyo (JP)

( * ) Notice: Subject to any disclaimer, the term of this patent is extended or adjusted under 35 U.S.C. 154(b) by 469 days.

(21) Appl. No.: 10/139,323

(22) Filed: May 7, 2002

(65) Prior Publication Data

US 2003/0008793 A1 Jan. 9, 2003

(30) Foreign Application Priority Data

May 8, 2001 (JP) ..... 2001-137792
Mar. 15, 2002 (JP) ..... 2002-071488

(51) Int. Cl.
*C11D 3/37* (2006.01)
*C11D 3/12* (2006.01)

(52) U.S. Cl. ..... 510/418; 510/407; 510/438; 510/434; 510/475; 510/509; 510/511; 510/507; 510/531; 510/532; 510/304; 510/315; 510/323; 510/371; 510/395; 510/398

(58) Field of Classification Search ..... 510/407, 510/418, 438, 434, 475, 509, 511, 507, 531, 510/532, 304, 315, 323, 371, 395, 398
See application file for complete search history.

(56) References Cited

U.S. PATENT DOCUMENTS 5,534,183 A * 7/1996 Gopalkrishnan et al. .... 510/434
5,733,861 A * 3/1998 Gopalkrishnan et al. .... 510/418

FOREIGN PATENT DOCUMENTS

| | | | |
|---|---|---|---|
| EP | 0 510 762 | A2 | 10/1992 |
| EP | 510762 | A2 * | 10/1992 |
| EP | 1 162 255 | A2 | 12/2001 |
| JP | 58-47099 | | 3/1983 |
| JP | 60-39319 | | 9/1985 |
| JP | 3-86800 | | 4/1991 |
| JP | 5-140599 | | 6/1993 |
| JP | 7-508781 | | 9/1995 |
| JP | 10 237496 | A | 9/1998 |

* cited by examiner

*Primary Examiner*—Charles Boyer
(74) *Attorney, Agent, or Firm*—Birch, Stewart, Kolasch & Birch, LLP

(57) ABSTRACT

The liquid detergent composition is provided with a high detergency and ensuring a good dispersion stability of builder particles and comprises a liquid dispersion containing (a) 30 mass % or more of a specific inorganic builder particle and (b) a block or graft polymer having a carboxyl group (i) and a polymer chain (ii), having, as its structural unit, an alkyleneoxy group, the composition having a viscosity (25° C.) of 3000 mPa·s or less and a volumetric separation rate (25° C., allowed to stand for 30 days) of 5% or less.

13 Claims, No Drawings

LIQUID DETERGENT COMPOSITION COMPRISING A POLYMER HAVING A CARBOXYL GROUP AND AN ALKYLENEOXY GROUP

TECHNICAL FIELD OF THE INVENTION

The present invention relates to a liquid detergent composition useful in wide fields such as detergents for washing fiber products, kitchen detergents, housing detergents, detergents for cleaning various hard surfaces and liquid cleansers.

PRIOR ARTS

Liquid detergents generally have the merits that these detergents have higher solubility in water and can be applied directly to soiled parts as compared with powdery detergents, and also, have the advantages that they require no drying step when produced, permits the compounding of thermally unstable materials which cannot be compounded in powdery detergents and do not require complicated manufacturing equipment such as drying facilities.

It is desired to compound alkali agents, calcium-trapping agents, bleaching agents, enzymes, polishing agents and the like which have auxiliary detergent effects in the liquid detergent. These materials are components existing as solids in the liquid detergent. However, in the case of, particularly, liquid detergents containing solid components, such a problem tend to arise that the solid components are precipitated and separated during storage and are not easily redispersed and these detergents are not easily injected into a washer because of high viscosity of the product. Methods have been adopted in which the viscosity of the liquid component is increased and the particle diameter of the solid is decreased to restrain the precipitation of the solid components. However, there is a limitation on an increase in the viscosity because of hardness of injection and stable dispersion is not attained only by decreasing the particle diameter of the solid.

For the purpose of stabilizing the dispersion of solid components, disclosed are liquid detergent compositions containing a copolymer consisting of 30% dehydrated maleic anhydride and ethylene or vinyl methyl ether in the publication of JP No. B No. 60-39319, an amphipathic carboxy-containing polymer in the publication of JP-A No. 3-86800, a copolymer containing a monomer having a group which can be extended from the surface of a solid and a monomer having group which can be associated with the solid in the publication of JP-A No. 5-140599 and a polymer containing a group exhibiting self-association in a liquid phase and a monomer soluble in the liquid phase in the publication of JP-A No. 7-508781 respectively. However, in these compositions, the solid components have been stabilized by a network structure formed by the polymer and therefore the composition is increased in viscosity and has handling difficulties. It is difficult to decrease the viscosity without impairing the dispersion stability of the solid components. Specifically, even if the viscosity is decreased by adding a solvent and the like, the dispersion stability of the solid components is lowered, resulting mostly in the production of a composition unsuitable as a detergent.

JP-A 58-47099 shows a detergent builder of a copolymer of polyalkylene glycol monoaryl ether and maleic acid monomer. EP-A 1162255, published on Dec. 12, 2001, discloses a liquid detergent composition comprising a polymeric dispersant and a crystalline silicate compound or an aluminosilicate compound.

It is an object of the present invention to provide a liquid detergent composition having high detergency, a low viscosity allowing easy handling and good dispersion stability.

SUMMARY OF INVENTION

The present invention provides a liquid detergent composition comprising a liquid dispersion medium and a solid dispersoid dispersed in the liquid dispersion medium, the composition having a viscosity (25° C.) of 3000 mPa·s or less and a volumetric separation rate (25° C., allowed to stand for 30 days) of 5% or less, wherein at least part of the solid dispersoid is particles of at least one inorganic builder (a) [hereinafter referred to as a component (a)] selected from an aluminosilicate compound, a crystalline silicate compound and a carbonate and contained in an amount of 30 mass % or more per the composition and the liquid dispersion medium and/or the solid dispersoid contains a block or graft polymer (b) [hereinafter referred to as a component (b)] having a carboxyl group or a salt thereof (i) and a polymer chain (ii) containing the constituting unit of an alkyleneoxy group, preferably an ethyleneoxy group and/or a propyleneoxy group.

DETAILED EXPLANATION OF INVENTION

[Component (a)]

In the liquid detergent composition of the present invention, the ratio of the component (a) is preferably 30 to 69 mass % and more preferably 30 to 50 mass % in total.

Among the components (a), one or more aluminosilicate compounds represented by the formula (1) are preferable as the aluminosilicate compound.

$$(M^1_pM^2_qM^3_rO)_u\cdot(M^4_sM^5_tO)_v\cdot(Al_2O_3)_w\cdot(SiO_2) \quad (1)$$

wherein $M^1$, $M^2$ and $M^3$ each represent Na, K or H, $M^4$ and $M^5$ each represent Ca or Mg, p, q and r each denote a number of 0 to 2, provided that p+q+r=2, s and t each denote a number of 0 to 1, provided that s+t=1, u denotes a number of 0 to 1 and preferably 0.1 to 0.5, v denotes a number of 0 to 1 and preferably 0 to 0.1 and w denotes a number of 0 to 0.6 and preferably 0.1 to 0.5.

Examples of such an aluminosilicate compound include species A, X and P of various zeolites which are usually compounded in detergents and, particularly, the species A is preferable. Zeolite is a very excellent detergent builder because it has high cation-exchange ability. When zeolite is compounded, the detergency of the detergent composition is greatly heightened and this is therefore preferable. Examples of the zeolite include Toyobuilder which is commercially available from Toyo Soda Manufacturing Co., Ltd. It is also preferable to use fine particle zeolite produced in the method described in the publication of JP-A No. 2001-139322 because it is easily milled finely in the process for the production of the detergent composition of the present invention of which process will be explained later and the dispersion stability is thereby heightened. Generally, commercially available zeolite contains water in an amount of about 20%. When the water content exceeds the content of water intended in a composition, it is preferable that such commercially available zeolite be baked at 450 to 600° C. to remove water and then used.

Among the components (a), one or more crystalline silicate compounds represented by the formula (2) are preferable as the crystalline silicate compound.

$$(M^1_pM^2_qM^3_rO)\cdot(M^4_sM^5_tO)_x\cdot(SiO_2)_y \quad (2)$$

wherein $M^1$, $M^2$, $M^3$, $M^4$, $M^5$, p, q, r, s and t are each the same as defined in the formula (1), x denotes a number of 0 to 1 and y denotes a number of 0.9 to 3.5.

Specific examples of the crystalline silicate compound include layer sodium silicates, for example, SKS-6

(manufactured by Hoechst AG) and those described in the scope of the claim of the patent of the publication of JP Nos. 2525318, 2759243, 2618799, and 2525342 and the publication of JP-A No. 184946.

Also, the carbonate as the component (a) is preferably an alkali metal salt (e.g., Na and K) and more preferably a sodium salt. Given as examples of sodium carbonates (soda ash) are usually available dense ash and light ash.

The average particle diameter of all species of component (a) is desirably 10 μm or less, preferably 0.01 to 5 μm, more preferably 0.05 to 2 μm, particularly preferably 0.1 to 1.0 μm and most preferably 0.1 to 0.7 μm. Here, the average particle diameter means an average particle diameter in terms of volume-based particle diameter which is measured using a laser diffraction/scattering size distribution measuring device LA-910 (relative refractive index: 1.2 at 20° C. in Ethanol) manufactured by Horiba, Ltd., and hereinafter means this unless otherwise noted.

The components (a) as exemplified above are used singly or by mixing plural ones. The total amount of an aluminosilicate compounds and/or a crystalline silicate compounds in (a) component is preferably 50 to 100 mass %, more preferably 70 to 100 mass %. Particularly, in the present invention, the component (a) preferably contains an aluminosilicate compound and further a carbonate, especially sodium carbonate.

[Component (b)]

In the liquid detergent composition of the present invention, the ratio of the component (b) is preferably 0.1 to 10 mass %, more preferably 0.3 to 7 mass % and particularly preferably 0.5 to 5 mass % in order to obtain good dispersibility, particularly, to attain a volumetric separation rate of 5% or less and also to prevent an excessive rise in viscosity.

It is preferable that the component (b) have solubility or a good dispersibility in the liquid dispersion medium to be used in the composition in which the component (b) is to be compounded. This may be confirmed by the fact that no precipitate is visually found in the bottom of a beaker in a method in which the 300 mL beaker is charged with 5 g of a dried polymer, into which 95 g of the liquid dispersion medium to be used for the composition in which the component (b) is compounded is poured, the mixture is stirred using a magnet (3 cm in length) coated with Teflon (trademark) at 150 r/min, under heating at 20 to 80° C., depending on components, but usually 50° C., for 5 hours and then the solution is allowed to stand for 30 minutes (ambient temperature, 25° C.).

Also, the component (b) allows the component (a) to be stably dispersed. The stable dispersibility means that the volumetric separation rate after the liquid detergent composition of the present invention is stored at ambient temperature (25° C.) for one month after it is produced is 5% or less. The volumetric separation rate means the proportion of the volume occupied by a transparent liquid phase portion, appearing on the upper portion when the solid dispersoid is sedimented and separated, in the total volume of the composition. Concretely, the volumetric separation rate is measured by the method explained later.

This component (b) is a block or graft polymer having a carboxyl group on a salt thereof (i) as a portion which is considered to adsorb onto the component (a) and a polymer chain (ii) having, as its structural unit, an alkyleneoxy group as a portion which is considered to dissolve in the liquid dispersion medium. Although the component (b) may be a compound having any structure as far as it has the ability to disperse the component (a) stably, it is preferably a graft polymer and more preferably a polymer excluding a hydrocarbon group having 4 or more carbon atoms to suppress structural viscosity.

In the component (b), the ratio by mass of the polymer chain having the carboxyl group on a salt thereof (i) to the polymer chain (ii) having, as its structural unit, an alkyleneoxy group, namely (i)/(ii) is preferably 5/95 to 95/5 and more preferably 5/95 to 60/40 from the viewpoint of solubility in the liquid dispersion medium. In these ranges it has a high dispersing property because (b) is considered to balance itself between (i) the structure for adsorbing on the dispersoid and (ii) the structure for steric repulsion by dissolution in the liquid.

The liquid detergent composition of this invention includes the amount of 30 mass % or more of (a) component in order to have the high deteregency, therefor the high dispersibility of (b) component is demanded for the good stability of the liquid detergent composition. The preferable mass ratio of polymer chain (ii) to (I) leads that the cationic exchange ability of (b) component is preferably less than 150 $CaCO_3$ mg/g, more preferably less than 120 mg/g.

In the polymer chain (ii), the alkyleneoxy group is preferably ethyleneoxy group and/or propyleneoxy group and may be a homopolymer or a block or random copolymer. The average polymerization degree of the polymer chain (ii) is preferably 3 to 200 and more preferably 6 to 150 and particularly preferably 8 to 50 in view of the dispersibility of the component (a). The end of the alkyleneoxy group is not specified. It may have hydrogen atom or may be an ether group with a hydrocarbon group such as methoxy, ethoxy groups. Preferably the hydrocarbon group may be an alkyl group having 1 to 3 carbon atoms.

The portion having a carboxyl group is preferably a (co) polymer [(co)polymer means a homopolymer or a copolymer] of a vinyl monomer having a carboxyl group or a salt thereof. The vinyl monomer having a carboxyl group or a salt thereof is (meth)acrylic acid [(meth) acrylic acid means acrylic acid, methacrylic acid and mixtures of these acids] and its salts, styrenecarboxylic acid and its salt, maleic acid, such as maleic anhydride, maleic acid, a maleic monoester, a maleic monoamide and a mixture thereof, and their salts and itaconic acid and its salt and one or more ones selected from these compounds may be used.

The salt is preferably a metal, ammonium, an alkyl or alkenyl ammonium having 1 to 22 carbon atoms in total, a pyridinium substituted by an alkyl or alkenyl having 1 to 22 carbon atoms, an alkanolammonium having 1 to 22 carbon atoms in total or a basic amino acid. An alkali metal salt such as sodium salt and potassium salt is more preferable.

No particular limitation is imposed on a method of synthesizing a block or graft polymer and known methods may be selected. The component (b) is preferably a polymer obtained by polymerizing a monomer by using, as a solvent, one or more liquids constituting the liquid dispersion medium. Among these methods, a method in which using one or more liquids constituting the liquid dispersion medium, a vinyl monomer or the like is polymerized using a macroazo-initiator having an azo group in the polymer chain (macroazo-initiator method), a method using a compound having a polymerizable group on one terminal of the polymer chain (macro-monomer method), a method in which radical-polymerization of a monomer is newly carried out in the presence of a polymer to make the newly produced polymer chain connect to the polymer chain allowed to coexist in advance by a chain transfer reaction (chain transfer method) and a method in which the terminal of one polymer is reacted with a functional group in the chain of another polymer to produce a graft polymer.

Examples of the component (b) obtained in these methods include the following 1 to 5 in a preferable order. In addition, the following polymers may be copolymerized with a vinyl monomer having a hydrophilic group such as a sulfonic acid group, hydroxyl group, ester group, amide group or phosphoric acid group.

1. A copolymer of an ester, preferably monoester, of a polyalkylene glycol and a vinyl monomer having a carboxyl group or a salt thereof and a vinyl monomer having a carboxyl group or a salt thereof, especially a copolymer of a polyalkylene glycol (meth)acrylate and a vinyl monomer having carboxyl group or a salt thereof, more especially a copolymer of polyalkylene glycol(meth)acrylate and (meth)acrylic acid or a salt thereof. For example a copolymer of a polyethylene glycol mono(meth)acrylate and a (meth)acrylic acid or a salt thereof, a copolymer of poly(ethylene glycol/propylene glycol)mono (meth) acrylate and (meth)acrylic acid or a salt thereof are preferably included.
2. A copolymer of a polyalkylene glycol ether having a reactive unsaturated group and a vinyl monomer having a carboxyl group or a salt thereof and a copolymer of a polyalkylene glycol ether having a reactive unsaturation and (meth)acrylic acid or a salt thereof and/or a maleic monomer or a salt thereof are preferable.
3. A copolymer being obtainable by grafting a monomer having a carboxyl group or a salt thereof on a polyalkylene glycol. For example, a graft polymer obtained by radical-polymerizing acrylic acid or a salt thereof and maleic acid or a salt thereof in polyethylene glycol, polypropylene glycol or poly(ethylene glycol/propylene glycol).
4. A block polymer being obtainable by radical polymerization of a vinyl monomer having a carboxyl group or a salt thereof, preferably (meth)acrylic acid or a salt thereof, by using a polyethylene glycol macro-azo initiator.
5. A graft polymer being obtainable by combining a vinyl monomer having a carboxyl group, preferably poly(meth) acrylic acid or a salt thereof, with a polyalkylene glycol having a hydroxyl group at the terminal by dehydrating reaction.

In the polyalkylene glycol ether having a reactive unsaturated group of the above 2, the reactive unsaturated group is preferably a radical-polymerizable unsaturated group. The polyoxyalkylene glycol ether having a reactive unsaturated group is preferably represented by the formula (3):

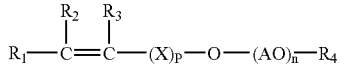

(3)

in which $R_1$, $R_2$ and $R_3$are the same as or different from one another and hydrogen atom, an alkyl group having 1 to 4 carbon atoms or phenyl group; $R_4$ is hydrogen atom, a straight or branched alkyl or alkenyl group having 1 to 22 carbon atoms, an aryl group having 6 to 22 carbon atoms, an alkylaryl or an arylalkyl group having 7 to 22 carbon atoms; n' number of AO's are the same as or different from one another and an alkyleneoxy group; n is a number of 3 to 200; p is zero or 1; X is an alkylene group having 1 to 12 carbon atoms, an arylene group having 6 to 12 carbon atoms or a divalent group shown by the formula (4):

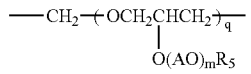

(4)

in which $R_5$is hydrogen atom, a straight or branched alkyl or alkenyl group having 1 to 22 carbon atoms, an aryl group having 6 to 22 carbon atoms, an alkylaryl or an arylalkyl group having 7 to 22 carbon atoms; m' number of AO's are the same as or different from one another and an alkyleneoxy group; q is a number of 1 to 10; m is a number of zero to 200.

In the formula (3), $R_1$, $R_2$ and $R_3$are the same as or different from one another and preferably hydrogen atom or methyl group.

$R_4$ of the formula (3) and $R_5$of the formula (4) are the same as or different from each other and preferably hydrogen atom, an alkyl group having 1 to 8 carbon atoms or phenyl. An alkyl group having 1 to 3 carbon atoms is more preferable and methyl group is especially preferable. For example are included methyl, ethyl, propyl, isopropyl, butyl, t-butyl, pentyl, hexyl, heptyl, octyl group etc.

X of the formula (3) is preferably an alkylene group having 1 to 8 carbon atoms, more preferably an alkylene group having 1 to 3 carbon atoms, for example methylene, ethylene, propylene and trimethylene group. Methylene group is especially preferable.

AO's of the formulas (3) and (4) are the same as or different from one another and preferably an alkyleneoxy group having 2 to 4 carbon atoms, being optionally a block polymer, a random polymer or an alternatively polymerized one. It is preferable that m and n are the same as or different from each other and 3 to 100, more preferably 3 to 50. The sum of m+n is preferably 3 to 20, more preferably 6 to 100. When AO is a homopolymer of $C_2$ ethyleneoxy group, $R_4$ and $R_5$, shown above, are the same as or different from each other and preferably another group than hydrogen atom. In particular (AO)n and (AO)m are the same as or different from each other and preferably a block or random polymer shown by the formula (5). The block polymer is more preferable, which has preferably ethyleneoxy group close to the reactive unsaturated group $R_1R_2C{=}C(R_3)$.

$$-[(C_2H_4O)_r/(C_3H_6O)_s]- \quad (5)$$

in which r is a number of 3 to 130 and s is a number of 1 to 50. r is preferably a number of 3 to 50 and s is preferably a number of 1 to 30.

In the formula (3) p is preferably 1 and in the formula (4) q is preferably 1 to 5, especially 1.

The compound of the formula (3) where p=0 can be synthesized, for example, by addition-polymerizing an alkylenoxide to allyl alcohol under alkaline addition. When p=1, it can be produced, for example, by adding glycidol to allyl alcohol and then addition-polymerizing an alkyleneoxide under alkaline condition. When R4 of the formula (3) and/or R5 of the formula (4) is not hydrogen atom, the compound can be produced, by Williamson synthesis, by ether reaction with an alkylating agent in the presence of an amine.

The polyalkylene glycol ether having a reactive unsaturated group to use in the invention is determined in view of a weight-average molecular weight according to GPC method ① below shown. It is preferably 500 to 5000, more preferably 1000 to 4000.

The weight average molecular weight of the component (b) is preferably 1,000,000 or less, more preferably 1000 to 500,000 and particularly preferably 5000 to 300,000 with the intention of preventing an excessive rise in viscosity. The weight-average molecular weight was determined according to GPC method ② below shown.

The ratio by mass of the component (a) to the component (b) in the liquid detergent composition of the present invention, namely (b)/(a) is preferably 1/80 to 1/4, more preferably 1/60 to 1/5 and particularly preferably 1/40 to 1/8 in view of the dispersion stability of the component (a)

[Liquid Dispersion Medium]

In the liquid detergent composition of the present invention, the ratio of the liquid dispersion medium is preferably 30 to 69 mass % and more preferably 40 to 69 mass %.

This ratio of the liquid dispersion medium can be approximately regarded as the ratio of the total compounded amount (mass %) of the nonionic surfactant, the hydroxyl group-containing water-soluble organic solvent and water in the liquid detergent composition. The ratio of the liquid dispersion medium may be normally found by precipitating solids in the liquid detergent composition by using a centrifuge and optionally by filtering the precipitated components to measure the amount of the filtrate.

The liquid dispersion medium is constituted of a liquid and components dissolved in the liquid, contains a surfactant as its essential component and preferably contains water and a water-soluble organic solvent. Although the liquid dispersion medium may contain water, the ratio of water in the liquid dispersion medium is preferably 40 mass % or less, more preferably 3 to 20 mass %, particularly preferably 3 to 15 mass % and most preferably 3 to 12 mass % for attaining a compact detergent composition. The lower limit is preferably 0.1 mass % or more and more preferably 1 mass % or more in view of production easiness.

The ratio of the surfactant in the liquid dispersion medium is preferably 10 to 90 mass %, more preferably 30 to 80 mass % and particularly preferably 50 to 70 mass %. The ratio of all surfactants (including those which are insoluble in the liquid dispersion medium and will be explained later) in the liquid detergent composition is preferably 3 to 65 mass %, more preferably 15 to 60 mass % and particularly preferably 20 to 50 mass %. As the surfactant, nonionic surfactants are preferable and an anionic surfactant, cationic surfactant or amphoteric surfactant may be used by dissolving it together with the nonionic surfactant in the liquid dispersion medium to the extent that it does not impair the stability of the product.

The ratio of the component (b) to all the surfactants is, in the liquid detergent of the invention, preferably 1/80–1/4.1, more preferably 1/60–1/4.5, especially preferably 1/30–1/5 from the viewpoint of stability of the liquid detergent.

In the present invention, components capable of constituting the liquid dispersion medium are shown below.

(1) Nonionic Surfactant

A nonionic surfactant has been used by compounding it in a detergent composition and is suitable from the viewpoint of high detergency and stability. The ratio of the nonionic surfactant in all surfactants is preferably 70 to 100 mass %, more preferably 90 to 100 mass % and particularly preferably 100 mass %.

As the nonionic surfactant, for example, known nonionic surfactants described in the publication of Japan Patent Office "WELL-KNOWN AND USUAL TECHNOLOGIES (Powdery detergent for clothes) Chapter 3-1" may be exemplified.

In the liquid detergent composition of the present invention, it is preferable to use, particularly, a polyethylene oxide and/or polypropylene oxide-based nonionic surfactant and it is particularly preferable to use one or more ones selected from polyoxyethylene alkyl ethers obtained by adding 5 to 20 mols (in average) of ethylene oxide (hereinafter referred to as EO) to a straight or branched chain primary or secondary alcohol having 8 to 18 carbon atoms and poly(oxyethylene/oxypropylene) alkyl ethers obtained by adding 5 to 15 mols (in average) of EO and 1 to 5 mols (in average) of propylene oxide (hereinafter referred to as PO) to the above alcohol (wherein EO and PO may be added either random-wise or block-wise).

As other nonionic surfactants, polyoxyethylene alkylphenyl ethers, N-polyoxyethylenealkylamine, cane sugar fatty acid esters, fatty acid glycerol monoesters, higher fatty acid alkanolamides, polyoxyethylene higher fatty acid alkanolamides, amine oxides, alkylglycosides, alkylglycerol ethers, N-alkyl gluconamides and the like may be used.

(2) Anionic Surfactant

In the liquid detergent composition of the present invention, for example, known anionic surfactants described in the publication of Japan Patent Office "WELL-KNOWN AND USUAL TECHNOLOGIES (Powdery detergent for clothes) Chapter 3-1" may be used. Particularly, a sulfonate, sulfate, phosphate and/or carboxylate-based anionic surfactant is preferably compounded.

Specifically, one or more anionic surfactants selected from alkyl or alkenyl benzene sulfonates, alkyl or alkenyl sulfates, polyoxyethylene alkyl or alkenyl ether sulfate (average EO addition mol number: 0.5 to 6 mols), monoalkyl or alkenyl phosphates and fatty acid salts which have a straight or branched chain alkyl group or alkenyl group having 8 to 22 (in average) carbon atoms are preferable.

Given as examples of a counter ion of the anionic surfactant are sodium, potassium, magnesium, calcium and a cation, for example, protonated amines such as ethanolamine, quaternary ammonium salts and mixtures of these materials. When the anionic surfactant is compounded, a method may be used in which it is compounded in an acid state and then an alkali (e.g., ethanolamine) is separately added.

(3) Cationic Surfactant

In the liquid detergent composition of the present invention, for example, known cationic surfactants described in the publication of Japan Patent Office "WELL-KNOWN AND USUAL TECHNOLOGIES (Powdery detergent for clothes) Chapter 3-1" may be used. For example, a quaternary ammonium salt of a benzalkonium compound or the like is preferably compounded.

(4) Amphoteric Surfactant

In the liquid detergent composition of the present invention, for example, known amphoteric surfactants described in the publication of Japan Patent Office "WELL-KNOWN AND USUAL TECHNOLOGIES (Powdery detergent for clothes) Chapter 3-1" may be used. For example, an alkylbetaine-based amphoteric surfactant or the like is preferably compounded.

(5) Hydroxyl Group-Containing Water-Soluble Organic Solvent

The hydroxyl group-containing water-soluble organic solvent is compounded in the liquid detergent composition of the present invention for the purposes of controlling the viscosity of the product, preventing the gelation of a nonionic surfactant and controlling the solubility in washing water. Further, when producing the component (b), it may be used as a part of a polymerization solvent for the control of the molecular weight of the component (b).

Although no particular limitation is imposed on the hydroxyl group-containing water-soluble organic solvent, those represented by the formula (6) and/or the formula (7) and/or the formula (8) and/or the formula (9) are preferable.

$$HO[CH_2CH_2O]_a[CH_{2-b}(CH_3)_bCH_{2-c}(CH_3)_cO]_dH \quad (6)$$

$$HO[CH_2CH_2O]_a[CH_{2-b}(CH_3)_bCH_{2-c}(CH_3)_cO]_d\text{-}Ph \quad (7)$$

$$CH_{3-e}(OH)_eCH_{2-f}(OH)_fCH_{3-g}(OH)_g \quad (8)$$

$$CH_{3-h}(OH)_hCH_{2-i}(OH)_iCH_{2-j}(OH)_jCH_{3-k}(OH)_k. \quad (9)$$

wherein a denotes an average number of 1 to 120 and d denotes an average number of 0 to 30, provided that a>d. b, c, e, f, g, h, i, j and k respectively denote an integer of 0 or 1, provided that b+c=1, e+f+g=2 or 3 and h+i+j+k=2 and Ph represents a phenyl group.

In the liquid dispersion medium, the ratio of the hydroxyl group-containing water-soluble organic solvent is preferably 7 to 60 mass %, more preferably 7 to 50 mass % and particularly preferably 15 to 40 mass %. In the liquid detergent composition, the ratio of the hydroxy group-containing water-soluble organic solvent solvent is preferably 2.1 to 41.4 mass %, more preferably 2.8 to 34.5 mass %, the most preferably 6 to 27.6 mass %.

Specific examples of the hydroxyl group-containing water-soluble organic solvent include polyhydric alcohols such as butanediol, pentanediol, hexanediol, glycerol, trimethylolpropane and pentaerythritol, mono-, di- or tri-alkyl ethers of polyhydric alcohols, glycols such as ethylene glycol, propylene glycol, polyethylene glycol, polypropylene glycol and poly(ethylene glycol/propylene glycol)and monoalkyl ethers or monoaryl ethers of glycols and particularly monophenyl ethers of glycols. These hydroxyl group-containing water-soluble organic solvents may be compounded singly or as mixtures of two or more.

(5) Other Organic Solvents

As other organic solvents, an alkylamine, aliphatic amine, amides or alkylesters of aliphatic or aromatic carboxylic acid, lower alkyl ester, ketone, aldehyde, glyceride or the like is compounded. In the liquid dispersion medium, the ratio of the other organic solvent is preferably 0 to 50 mass %, more preferably 0 to 20 mass % and particularly preferably 0 to 10 mass % from the viewpoint of detergency and the formation of a compact detergent composition.

(6) Water

Water may be incorporated for the purposes of adjustment of product's viscosity, prevention of gelation of a nonionic surfactant and a controlled solubility in washing water. The ratio of compounded water except water absorbed on the inorganic builder component (a) in the liquid detergent composition is preferably 1 to 30 mass %, more preferably 1 to 15 mass %, in particular 2 to 12 mass %.

In the liquid detergent composition of the present invention, the ratio by mass of the liquid dispersion medium to the component (a), namely, liquid dispersion medium/component (a) is preferably 1/3 to 3/1 and more preferably 1/2 to 2/1 from the viewpoint of dispersion stability.

[Other Components]

The liquid detergent composition of the present invention may comprise, as the other components, surfactants which are insoluble in the liquid dispersion medium, inorganic builders, organic builders, bleaching agents and general detergent additives. These components may be used in combinations of two or more. Like the component (a), these components may be compounded by dispersing each in the detergent composition. At this time, these components may be mixed with the component (a) before the component (a) is crushed, and crushed and dispersed together with the component (a) or may be mixed after the component (a) is crushed. Specific examples of the other components are shown below.

Others-1: Surfactants Insoluble in the Liquid Dispersion Medium

The liquid detergent composition preferably contains a surfactant in the liquid dispersion medium. Other than this surfactant, a surfactant insoluble in the liquid dispersion medium may be dispersed as a solid dispersoid.

Others-2: Inorganic Builder

Known detergent builders such as silicates and methasilicates maybe optionally compounded. These builders are preferably alkali metal salts. For example, phosphates such as tripolyphosphate and pyrophosphate, aminotri (methylenephosphonic acid), 1-hydroxyethylidene-1,1-diphosphonic acid, ethylenediaminetetra (methylenephosphonic acid), diethylenetriaminepenta (methylenephosphonic acid) or salts of these compounds may be used.

Others-3: Organic Builder

The liquid detergent composition of the present invention may contain a known organic builder which is soluble in the liquid dispersion medium and/or a known organic builder which is insoluble in the liquid dispersion medium. Specific examples of the organic builder include polyvalent carboxylic acids such as citric acid, succinic acid and malonic acid, amino acids such as aspartic acid and glutamic acid, aminopolyacetic acids such as nitrilotriacetic acid and ethylenediaminetetraacetic acid and high molecular polyvalent carboxylic acid such as polyacrylic acid and acrylic acid/maleic acid copolymers. These compounds are preferably used in the forms of an alkali metal salt, ammonium salt or substituted ammonium salt. The ratio of the organic builder in the liquid detergent composition is preferably 0.5 to 15.0 mass %, more preferably 1.0 to 10.0 mass %, especially 2.0 to 7.0 mass %.

Others-4: Bleaching Agent

The liquid detergent composition of the present invention preferably contains a bleaching agent. As the bleaching agent, an inorganic peroxy bleaching agent or a combination of an inorganic peroxy bleaching agent and a bleaching activator may be used.

Examples of the inorganic peroxy bleaching agent include perborates, percarbonates, persilicates and perphosphates of alkali metals. Particularly, sodium perborate and sodium percarbonate are preferable. Also, percarbonates coated with a carboxylic acid polymer and/or polyvalent carboxylic acid as exemplified in the publication of JP-A No. 11-279593, page 2, column 2, line 13 to line 44 may be used in order to improve the dispersion stability of the product.

In the case of using a combination of an inorganic peroxy bleaching agent and a bleaching activator, the bleaching activator is an organic compound having one or more reactive acyl groups which generally form a peracid. A more effective bleaching action is obtained in the case of using the bleaching activator as compared with the case of using the inorganic peroxy bleaching agent independently. Although there is no particular limitation to the structure of the bleaching activator, those represented by the formula (10) are preferable.

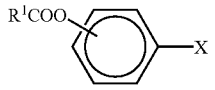

(10)

wherein $R^6$ represents a straight or branched chain alkyl group having 1 to 15 carbon atoms and X represents COOM or $SO_3M$ (where M represents a hydrogen atom, an alkali metal atom or alkali earth metal atom).

Among the bleaching activators represented by the formula (10), those of the formula (10) in which $R^6$ is a straight or branched chain alkyl group having 7 to 11 carbon atoms and X is COOH or $SO_3Na$ are preferable. Examples of such a bleaching activator may include sodium lauroyloxybenzenesulfonate, sodium decanoyloxybenzenesulfonate, sodium octanoyloxybenzenesulfonate, lauroyloxy benzoate, decanoyloxy benzoate and octanoyloxy benzoate.

Besides the above components, polymers such as polyethylene glycol and carboxymethyl cellulose, color-transfer preventive agents such as polyvinyl pyrrolidone, enzymes such as protease, cellulase and lipase, enzyme stabilizers such as calcium chloride, formic acid and boric acid, antifoaming agents such as silicone, antioxidants such as butylhydroxytoluene, distyrenized cresol, sodium sulfite and sodium hydrogen sulfite, perfumery components, dyes, fluorescent dyes and pigments may be contained according to the need.

[Production Method]

The production of the liquid detergent composition of the present invention involves a step of subjecting the solid matter including the component (a) to wet grinding to obtain a refined solid dispersoid slurry. It is preferable to mix all the components with stirring to form a slurry, followed by wet grinding to produce the composition. Alternatively a mixture the component (a) and part of the other components may be preferably wet ground and then mixed with the other part.

In a more preferable method for the production of the liquid detergent composition, the component (a) and the component (b) are brought into contact with each other, preferably, in a solvent, then the solvent is distilled and these components are then mixed with the liquid dispersion medium, followed by wet grinding. As the solvent, lower alcohol solvents such as ethanol and methanol, or aliphatic hydrocarbons such as hexane, heptane, dodecane, cyclohexane, methylcyclohexane, isooctane and hydrogenated triisobutylene and aromatic hydrocarbons such as benzene, toluene, xylene and ethylbenzene are exemplified.

Alternatively, it is preferable that the solid dispersoid be refined in advance by using a dry crusher and mixed with the liquid dispersion medium, followed by stirring or wet grinding to produce the detergent composition. In the case of using a solid dispersoid which is sufficiently small-sized in advance by dry grinding or the like, the liquid detergent composition can be obtained in a simple manner by using a dispersing machine such as a flow jet mixer.

Given as examples of the wet grinding method are methods using a stone mill, colloid mill, KD mill, slasher mill, high-speed disperser, media mill, roll mill, kneader, extruder, a grinder with a liquid jet interaction chamber (e.g., Microflydizer, manufactured by Microflyde Co. Ltd.) or ultrasonic dispersing instrument etc. Particularly, a wet grinding method using media, for example, methods using a sand mill, sand grinder, wet vibrating mill or attritor are preferable in view of grinding efficiency. As the media, known materials such as titania or zirconia may be applied.

In the case of grinding using a sand mill, media having a diameter of 0.1 to 1.0 mm are particularly suitable. When the particle size of the solid builder is very large, there is the case where efficient fine grinding is attained by using media having a large diameter, for example, 2 mm in advance to perform grinding and in succession by using media having a smaller diameter to perform grinding.

When performing wet grinding, the ratio (mass ratio) of solid dispersoid mixture/liquid dispersion medium is preferably 30/70 to 60/40 to heighten the efficiency in grinding the solid dispersoid.

Although the wet grinding is terminated when the average particle diameter becomes a size enough to allow stable dispersion, the grinding time is preferably 3 minutes or more and more preferably 5 minutes or more.

When performing wet grinding, the liquid dispersion medium may be added in several parts to keep the viscosity of the system low and to heighten grinding efficiency.

The average particle diameter of the refined solid dispersoid obtained after the wet grinding is properly 10 μm or less, preferably 0.01 to 5 μm, more preferably 0.05 to 2 μm, particularly preferably 0.1 to 1.0 μm, the most preferably 0.1 to 0.7 μm.

The component (b) used in the liquid detergent composition of the invention works as a dispersant providing the solid dispersoid with a sufficient chemical stability in the composition. In addition, it works as a dispersant of soil during washing, that is, as an anti-redeposit to prevent soil released from washed objects from depositing again on the washed objects. It is considered because the component (b) is adsorbed at the carboxyl group or a salt thereof (i) on the dispersoid, the polymer chain (ii) composed of an alkyleneoxy group is soluble in the liquid part and therefore the dispersoid is prevented from coagulating and forming a network and is maintained in a good dispersion having a low viscosity. In laundering water, on the other hand, the copolymer adsorbs to soil and renders the surface of soil anionic and the soil is dispersed out in water due to ionic repulsion. It is considered that redeposition on washed objects is this way prevented. The liquid detergent composition of the invention may have a low viscosity since a good dispersion can be obtained.

The viscosity of the liquid detergent composition of the present invention is preferably 3000 mPa·s or less, more preferably 2000 mPa·s or less, especially preferably 1000 mPa·s or less, the most preferably 700 mPa·s or less. The viscosity of 10 mPa·s or more is preferable to prevent the liquid detergent from scattering and enhance the stability of an inorganic builder, more preferably 50 mPa·s or more.

The liquid detergent composition of the present invention, in which fine inorganic particles including the component (a) are stably dispersed in the liquid dispersion medium containing surfactants and the like owing to the component (b) without increasing the viscosity of the product, is easily poured into a washing tank and dissolved quickly in laundery water with the result that the detergency is improved.

EXAMPLES

Addition polymerization of ethylene oxide or propylene oxide was carried out in a stainless steel autoclave. Potassium hydroxide to use as a catalyst is in the form of plate-shaped pellets in the industrial grade, having a purity of about 96 mass % with the principal balance of water.

Polymerization of a vinyl monomer was carried out in a separable flask of glass in nitrogen gas. Water was ion-exchanged water. 80 mass % aqueous solution of acrylic acid was a product of Toa Gousei Co., Ltd. 35 mass % aqueous hydrogen peroxide was a product of Kishida Chemical Co., Ltd. Triethylene glycol monophenyl ether was PHG-30 (tradename) of Nihon Nyukazai Co., Ltd. The other reagents and solvents were $1^{st}$ grade-products of Wako Junyaku Industry Co., Ltd. if not specified below.

The molecular weight was determined with gel permeation liquid chromatography (GPC) with either of the following conditions. Elutants and added salts were prepared from liquid chromatographic reagents.

Condition ①

Column: two of α-M of Toso Co., Ltd.

Eluant: dimethylformamide including 60 mM of phosphoric acid and 50 mM of lithium bromide Detector: differential refractometer Temperature: 40° C.

Standard: polyethylene glycol, polyethylene oxide

Measuring concentration: 5 mg/ml

Injected amount: 100 μl

Condition ①

Column: G4000PWXL+G2500PWXL of Toso Co., Ltd.

Eluant: 0.2 M of phosphoric acid buffer(pH 6.9)/acetonitrile=9/1 by volume

Detector: differential refractometer

Temperature: 40° C.

Standard: polyethylene glycol, polyethylene oxide

Measuring concentration: 5 mg/ml

Injected amount: 100 μl

Synthesis Example 1

Synthetic polymer (1), Synthetic Example of [Block polymer of polyethylene glycol and polyacrylic acid (40/60 (ratio by mass))]

40 g of poly[polyoxyethylene 4,4'-azobis(4-cyanopentanoate)] (VPE-0201, manufactured by Wako Pure Chemical Industries, Ltd.) and 60 g of acrylic acid were dissolved in 300 g of ion-exchanged water, the mixture was stirred for 10 minutes in a nitrogen atmosphere and heated. Then the mixture was continuously stirred for 6 hours while keeping the mixture at 65 to 70° C. While the reaction mixture was ice-cooled, 110 mL of aqueous 6N sodium hydroxide solution was gradually added to neutralize, thereby converting about 80% of the carboxyl group of the polymer into a sodium salt. The resulting aqueous solution was freeze-dried to obtain a synthetic polymer (1). The resulting synthetic polymer (1) was subjected to GPC measurement and as a result, the weight average molecular weight was 222,000 (converted into polyethylene glycol). The condition of GPC measurement was ②/Only in this case the column was as follows.: column: TSK GMPWXL manufactured by Tosoh Corporation, two columns.

Synthesis Example 2

Synthetic polymer (2), Synthetic Example of [Copolymer of polyethylene glycol (EO addition mol number: 9) monomethacrylate/methacrylic Acid=80/20 (ratio by mass)]

A solution prepared by dissolving 80 g of polyethylene glycol (EO addition mol number: 9) monomethacrylate (NK-Ester M-90G, manufactured by Shin-Nakamura Chemical Co., Ltd.), 20 g of methacrylic acid neutralized by 7.8 g of 48% sodium hydroxide and 4.5 g of 2-mercaptoethanol in 40 g of ion-exchanged water and a solution prepared by dissolving 4.6 g of sodium persulfate in 42 g of ion-exchanged water were respectively added dropwise to 100 g of ion exchange water, which was heated to 100° C. in a nitrogen atmosphere, for two hours while the mixture was kept at 100 to 105° C. Then, the stirring was continued for further one hour while the mixture was kept at 100° C. After the temperature of the system was returned to ambient temperature, 10.8 g of aqueous 35% hydrogen peroxide was used to deodorize and excess aqueous hydrogen peroxide was reduced by 1.9 g of 35% sodium hydrogen sulfite. The resulting aqueous solution was freeze-dried to obtain a synthetic polymer (2). The resulting synthetic polymer (2) was subjected to GPC measurement and as a result, the weight average molecular weight was 39,000 (converted into polyethylene glycol). The condition of GPC measurement was ②.

Synthesis Example 3

Synthetic polymer (3), Synthetic Example of [Graft polymer of polyethylene glycol and poly(acrylic acid/maleic acid=70/30 (mol ratio)) (50/50 (ratio by mass))]

50 g of polyethylene glycol (polyethylene glycol 2,000, manufactured by Wako Pure Chemical Industries, Ltd.) and 20.4 g of maleic acid were dissolved under heating in a nitrogen atmosphere and heated to 150° C. while continuing stirring. 29.6 g of acrylic acid and 4.3 g of di-t-butyl peroxide were separately added to the resulting solution over one hour while keeping the solution at 145 to 150° C., further the stirring was continued for 3 hours while keeping the solution at 150° C. and the temperature of the system was returned to ambient temperature. The reaction solution was diluted by adding 200 mL of ion-exchanged water. While the reaction solution was ice-cooled, 100 mL of aqueous 6N sodium hydroxide solution was gradually added to neutralize, thereby converting about 80% of the carboxyl group of the polymer into a sodium salt. The resulting aqueous solution was freeze-dried to obtain a synthetic polymer (3). The resulting synthetic polymer (3) was subjected to GPC measurement and as a result, the weight average molecular weight was 45,000 (converted into polyethylene glycol). The condition of GPC measurement was ②.

Synthesis Example 4

Synthetic polymer (4), Synthetic Example of [Copolymer of polyethylene glycol (EO addition mol number: 23) monomethacrylate/methacrylic acid=50/50 (ratio by mass)]

50 g of polyethylene glycol (EO addition mol number: 23) monomethacrylate and 50 g of methacrylic acid were dissolved in 750 g of polyethylene glycol (EO addition mol number: 3) monophenyl ether (PHG-30, manufactured by Nippon Nyukazai Co., Ltd.) and the mixture was stirred for 10 minutes in a nitrogen atmosphere. To the mixture was added 8 g of 2,2'-azobis-(2,4-dimethylvaleronitrile) (V-65, manufactured by Wako Pure Chemical Industries, Ltd.) and the resulting mixture was heated in a nitrogen atmosphere and stirred for 6 hours while the mixture was kept at 75 to 80° C. Then, the temperature of the system was returned to ambient temperature to obtain a synthetic polymer (4) (concentration of the polymer (4): 11.7 mass %). The resulting synthetic polymer (4) was subjected to GPC measurement and as a result, the weight average molecular weight was 31,000 (converted into polyethylene glycol). The condition of GPC measurement was ②.

Synthesis Example 5

Synthetic polymer (5), Synthetic Example of [Copolymer of polyethylene glycol (EO addition mol number: 9) monomethacrylate/acrylic acid=20/80 (ratio by mass)]

A solution prepared by dissolving 20 g of polyethylene glycol (EO addition mol number: 9) monomethacrylate (NK-Ester M-90G, manufactured by Shin-Nakamura Chemical Co., Ltd.) and 80 g of acrylic acid in 80 g of ion-exchanged water and a solution prepared by dissolving 1.6 g of 2,2'-azobis-(2-methylpropionamidine) dihydrochloride (V-50, manufactured by Wako Pure Chemical Industries, Ltd.) in 120 g of ion-exchanged water were respectively added dropwise to 200 g of ion-exchanged water, which was heated to 60° C. in a nitrogen atmosphere, over two hours while the mixture was kept at 60 to 65° C. Then, the stirring was continued for further 6 hours while the mixture was kept at 65° C. After the temperature of the system was returned to ambient temperature, 150 mL of an aqueous 6N sodium hydroxide solution was gradually added under ice-cooling to neutralize, thereby converting about 80% of the carboxyl group of the polymer into a sodium salt. The resulting aqueous solution was freeze-dried to obtain a synthetic polymer (5). The resulting synthetic polymer (5) was subjected to GPC measurement and as a result, the weight average molecular weight was 49,000 (converted into polyethylene glycol) The condition of GPC measurement was ②.

Synthesis Example 6

Synthetic Polymer (6), Synthetic Example of [Copolymer of polyethylene glycol (EO addition mol number: 23) monomethacrylate/methacrylic acid/sodium styrenesulfonate=50/25/25 (mass ratio)]

A solution prepared by dissolving 60 g of ethanol, 40 g of polyethylene glycol (EO addition mol number: 23) monomethacrylate (NK-Ester M-230G, manufactured by Shin-Nakamura Chemical Co., Ltd.), 20 g of methacrylic acid and 20 g of sodium styrenesulfonate in 120 g of ion-exchanged water and by mixing these components and a solution prepared by dissolving 2.7 g of 2,2'-azobis-(2,4-dimethylvaleronitrile) (V-65, manufactured by Wako Pure Chemical Industries, Ltd.) in 24 g of ethanol were respectively added dropwise to 100 g of ethanol, which was heated to 80° C. in a nitrogen atmosphere, over two hours while the mixture was kept at 80 to 85° C. Then, the stirring was continued for further one hour while the mixture was kept at 80° C. and the temperature of the system was returned to ambient temperature. This mixed solution was reprecipitated and purified using acetone, followed by drying to obtain a synthetic polymer (6). The resulting synthetic polymer (6) was subjected to GPC measurement and as a result, the weight average molecular weight was 114,000 (converted into polyethylene glycol). The condition of GPC measurement was ②.

Synthesis Example 7

Synthetic Polymer (7), Synthetic Example of [Copolymer of polyethylene glycol (EO addition mol number: 34) allyl ether/maleic acid=20/80 (mol ratio)]

156.8 g of maleic acid anhydride and 313.6 g of polyethylene glycol (EO addition mol number: 34) allyl ether were dissolved in 400 g of ion-exchanged water. Then, the temperature of a vessel was raised to 70° C. and 60 g of an aqueous 48% sodium hydroxide solution was added to the mixture. Further, the atmosphere in the vessel was replaced by nitrogen and then the temperature in the vessel was raised up to 98° C. An aqueous initiator solution consisting of 42.8 g of aqueous 35% hydrogen peroxide and 4.77 g of sodium persulfate was added dropwise to the mixture in the above reactor over 6 hours and the temperature in the vessel was kept at 98° C. for further 4 hours. The resulting aqueous solution was freeze-dried to obtain a synthetic polymer (7). The resulting synthetic polymer (7) was subjected to GPC measurement and as a result, the weight average molecular weight was 18,000 (converted into polyethylene glycol). The condition of GPC measurement was ②.

Synthesis Example 8

Synthetic Polymer (8), Synthetic Example of [Copolymer of polyethylene glycol (EO addition molar number: 120) monomethacrylate/methacrylic acid=70/30 (ratio by mass)]

A solution prepared by dissolving 70 g of polyethylene glycol (EO addition mol number: 120) monomethacrylate and 30 g of methacrylic acid in 100 g of ion-exchanged water and a solution prepared by dissolving 1.6 g of 2,2'-azobis-(2-methylpropionamidine) dihydrochloride (V-50, manufactured by Wako Pure Chemical Industries, Ltd.) in 100 g of ion-exchanged water were respectively added dropwise to 200 g of ion-exchanged water, which was heated to 60° C. in a nitrogen atmosphere, over two hours while the mixture was kept at 60 to 65° C. Then, the stirring was continued for further 6 hours while the mixture was kept at 65° C. After the temperature of the system was returned to ambient temperature, 46.5 mL of an aqueous 6N sodium hydroxide solution was gradually added under ice-cooling to neutralize, thereby converting about 80% of the carboxyl group of the polymer into a sodium salt. The resulting aqueous solution was freeze-dried to obtain a synthetic polymer (8). The resulting synthetic polymer (8) was subjected to GPC measurement and as a result, the weight average molecular weight was 127,000 (converted into polyethylene glycol). The condition of GPC measurement was ②.

Synthesis Example 9

Synthetic Polymer (9), Synthetic Example of [Copolymer of polyethylene glycol (EO addition mol number: 23) monomethacrylate/phosphoric acid ethylmethacrylate/methacrylic acid=50/25/25 (ratio by mass)]

A solution prepared by dissolving 100 g of polyethylene glycol (EO addition mol number: 23) monomethacrylate, 50 g of phosphoric acid ethylmethacrylate (Phosmer M, manufactured by Uni-Chemical Co., Ltd.) and 50 g of methacrylic acid in 150 g of ethanol and a solution prepared by dissolving 5.8 g of 2,2'-azobis-(2,4-dimethylvaleronitrile) (V-65, manufactured by Wako Pure Chemical Industries, Ltd.) in 300 g of ethanol were respectively added dropwise to 300 g of ethanol, which was heated to 80° C. in a nitrogen atmosphere, over two hours while the mixture was kept at 80° C. Then, the stirring was continued for further one hour while the mixture was kept at 80° C. After the temperature of the system was returned to ambient temperature, the solution was reprecipitated and refined using hexane to obtain a synthetic polymer (9). The resulting synthetic polymer (9) was subjected to GPC measurement and as a result, the weight average molecular weight was 31,000 (converted into polyethylene glycol). The condition of GPC measurement was ②.

Synthesis Example 10

Synthetic polymer (10) obtained by copolymerizing acrylic acid and poly(ethylene glycol/propylene glycol) allylether having the formula (3) in Which p is 1; X is methylene; $R_1$, $R_2$, $R_3$ and $R_4$ are hydrogen atom; -(AO)n- is blocks of about 40 moles of ethyleneoxy units, added the closer to the allyl group, and about 13 moles of propyleneoxy units.

350 mass parts of ethyleneglycol monoallylether, manufactured by Nihon Nyukazai Co, Ltd., and 3.9 mass parts of potassium hydroxide were introduced in an autoclave and air thereof was replaced by nitrogen gas, sealed. The reaction mixture was, while stirred, heated at 150° C. 5736 mass parts of ethylene oxide was fed over about 4.5 hours at a pressure of about 0.4 Mpa or less. It was heated at 150° C. for further about 30 minutes and then was cooled to 80° C. 2062 mass parts of the obtained product was removed out. The remainder was further heated at 140° C. 1699 mass parts of propylene oxide was fed over about 3 hours at a pressure of about 0.4 Mpa or less. It was heated at 140° C. for further 1 hour and cooled to 80° C. The whole was separated to obtain the product. It was found to have a weight-average molecular weight of 3813 according to the before defined GPC condition ①.

480 mass parts of the obtained poly(ethylene glycol/propylene glycol)allylether was mixed with 300 mass parts of propylene glycol and 360 mass parts of water. The mixture was heated at 81–85° C., while stirred. A mixture of 150 mass parts of 80 mass % aqueous solution of acrylic acid and 101 mass parts of ion-excharged water and a mixture of 21.9 mass parts of sodium persulfate, 155 mass parts of Ion exchanged-water and 17.9 mass parts of 35 mass % aqueous hydrogen peroxide were, both at the same time, added dropwise over 2 hours thereto. The mixture was heated at 81–85° C. for further 4 hours and then cooled to the room temperature to obtain a colorless, transparent liquid. The obtained liquid was an aqueous solution comprising 37.6 mass % of the polymer and 18.8 mass % of propylene glycol. The obtained synthetic polymer (10) was found to have a weight-average molecular weight of 19,000 according to the GPC condition ②.

Synthesis Example 11

Synthetic polymer (11) obtained by copolymerizing acrylic acid and poly(ethylene glycol/propylene glycol) allylether having the formula (3) in which p is 1; X is the group having the formula (4); q is 1; $R_1$, $R_2$, $R_3$, $R_4$ and $R_5$ are hydrogen atom; -(AO)n- of the formula (3) and (4) is blocks of 44 moles in total of ethyleneoxy units, added the closer to the reactive unsaturated group, and 10 moles in total of propyleneoxy units.

400 mass parts of 3-allyloxy-1,2-propanediol, manufactured by Wako Junyaku Co, Ltd., and 6.79 mass parts of potassium hydroxide were introduced in an autoclave and air thereof was replaced by nitrogen gas, sealed. The reaction mixture was, while stirred, heated at 150° C. 2933 mass parts of ethylene oxide was fed over about 5 hours at a pressure of about 0.4 Mpa or less. It was heated at 150° C. for further about 30 minutes and then was cooled to 80° C. 1532 mass parts of the obtained product was removed out. The remainder was further/heated at 150° C. 1588 mass parts of ethylene oxide was fed over about 2 hours at a pressure of about 0.4 Mpa or less. It was heated at 150° C. for further 30 minutes and cooled to 140° C. 952 mass parts of propylene oxide was fed over about 3 hours at a pressure of about 0.4 Mpa or less. It was heated at 140° C. for further 1 hour and cooled to 80° C. The whole was separated to obtain the product. It was found to have a weight-average molecular weight of 3020 according to the before defined GPC condition ①.

540 mass parts of the obtained poly(ethylene glycol/propylene glycol)allylether was mixed with 300 mass parts of propylene glycol and 360 mass parts of ion-exchanged water. The mixture was heated at 81–85° C., while stirred. A mixture of 75.0 mass parts of 80 mass % aqueous solution of acrylic acid and 111 mass parts of ion-exchanged water and a mixture of 12.4 mass parts of sodium persulfate, 165 mass parts of ion-exchanged water and 10.2 mass parts of 35 mass % aqueous hydrogen peroxide were, both at the same time, added dropwise over 4 hours thereto. The mixture was heated at 81–85° C. for further 4 hours and then cooled to the room temperature to obtain a colorless, transparent liquid. The obtained liquid was an aqueous solution comprising 37.9 mass % of the polymer and 19.0 mass % of propylene glycol. The obtained synthetic polymer (11) was found to have a weight-average molecular weight of 22,000 according to the GPC condition ②.

Synthesis Example 12

Synthetic polymer (12) obtained by copolymerizing acrylic acid, maleic acid and polyethylene glycol ether having the formula (3) in which p is zero; $R_1$, $R_2$, $R_3$and $R_4$are hydrogen atom; -(AO)n- is about 46 moles of ethyleneoxy units.

310 mass parts of 2-hydroxylethyl vinyl ether, manufactured by Maruzen Petrochemical Co, Ltd., and 3.95 mass parts of potassium hydroxide were introduced in an autoclave and air thereof was replaced by nitrogen gas, sealed. The reaction mixture was, while stirred, heated at 150° C. 2325 mass parts of ethylene oxide was fed over about 2.5 hours at a pressure of about 0.4 Mpa or less. It was heated at 150° C. for further about 30 minutes and then was cooled to 80° C. 1181 mass parts of the obtained product was removed out. The remainder was further heated at 150° C. 1283 mass parts of ethylene oxide was fed over about 2 hours at a pressure of about 0.4 Mpa or less. It was heated at 150° C. for further 30 minutes and cooled to 80° C. 1697 mass parts of the obtained product was removed out. The remainder was further heated at 150° C. 487 mass parts of ethylene oxide was fed over about 1 hour at a pressure of about 0.4 Mpa or less. It was heated at 150° C. for further 30 minutes and cooled to 80° C. The whole was separated to obtain the product. It was found to have a weight-average molecular weight of 3200 according to the before defined GPC condition ①.

A mixture of 29.6 mass parts of maleic acid, 460 mass parts of ion-exchanged water and 38.0 mass parts of 80 mass % aqueous solution of acrylic acid was adjusted at a pH value of 8.5 with addition of about 110 mass parts of 6N aqueous solution of sodium hydroxide. 540 mass parts of the above obtained polyethylene glycol ether and 300 mass parts of propylene glycol were added to the mixture. The mixture was heated at 81–85° C., while stirred. A mixture of 4.44 mass parts of sodium persulfate, 65 mass parts of ion-exchanged water and 1.81 mass parts of 35 mass % aqueous hydrogen peroxide was added dropwise over 1 hour thereto. The mixture was heated at 81–85° C. for further 5 hours and then cooled to the room temperature to obtain a colorless, transparent liquid. The obtained liquid was an aqueous solution comprising 42.5 mass % of the polymer, the all carboxylic acid groups of which was calculated as acid type, and 21.2 mass % of propylene glycol. The obtained synthetic polymer (12) was found to have a weight-average molecular weight of 27,000 according to the GPC condition ②.

Synthesis Example 13

Synthetic polymer (13) obtained by copolymerizing acrylic acid and polyethylene glycol allyl ether having the formula (3) in which p is 1; X is methylene; $R_1$, $R_2$ and $R_3$ are hydrogen atom; $R_4$ is methyl; and AO is ethyleneoxy unit, Uniox PKA-5010, tradename of NOF Corporation, Ltd., announced to have a molecular weight of 1500.

420 mass parts of Uniox PKA-5010 and 420 mass parts of triethyleneglycol monophenyl ether were mixed and the mixture was heated at 100–105° C., while stirred. A mixture of 180 mass parts of acrylic acid and 210 mass parts of triethyleneglycol monophenyl ether and a mixture of 46.9 mass parts of t-butyl peroxy-2-ethylhexanoate and 344 mass parts of triethyleneglycol monophenyl ether were, both at the same time, added dropwise over 2 hours thereto. The mixture was heated at 100–105° C. for further 4 hours and then cooled to the room temperature to obtain a pale yellow, transparent liquid. The obtained liquid was a solution of trithyleneglycol monophenyl ether including 37.0 mass % of the polymer. The obtained synthetic polymer (13) was found to have a weight-average molecular weight of 26, 000 according to the GPC condition ②.

Synsis Example 14

Synthetic polymer (14) obtained by copolymerizing methacrylic acid and poly(ethylene glycol/propylene glycol) allyl ether having the formula (3) in which p is 1; X is methylene; $R_1$, $R_2$, $R_3$ and $R_4$ are hydrogen atom; and -(AO)n- includes ethyleneoxy unit and propyleneoxy units at a mole ratio of 75/25, Unisef PKA-5012, tradename of NOF Corporation, Ltd., announced to have a molecular weight of 2000.

300 mass parts of Unisef PKA-5012 and 300 mass parts of triethyleneglycol monophenyl ether were mixed and the mixture was heated at 100–105° C., while stirred. A mixture of 300 mass parts of methacrylic acid and 300 mass parts of trithyleneglycol monophenyl ether and a mixture of 39.3 mass parts of t-butyl peroxy-2-ethylhexanoate and 319 mass parts of triethyleneglycol monophenyl ether were, both at the same time, added dropwise over 2 hours thereto. The mixture was heated at 100–105° C. for further 4 hours and then cooled to the room temperature to obtain a pale yellow, transparent liquid. The obtained liquid was a solution of triethyleneglycol monophenyl ether including 38.5 mass % of the polymer. The obtained synthetic polymer (14) was found to have a weight-average molecular weight of 54,000 according to the GPC condition ②.

Synthesis Example 15

(Synthesis of Polyacric Acid)

100 mass parts of acrylic acid, 550 mass parts of 2-propanol and 6.90 mass parts of 2,2'-azobis(2,4-dimethylvaleronitrile) were mixed with one another and the mixture was heated at 62–63° C., while stirred under nitrogen atmosphere, for 5 hours, then cooled down to the room temperature. The solution was added dropwise over 30 minutes to 7000 mass parts of hexane stirred at the room temperature. The formed precipitates were collected with decantation. They were dried at a reduced pressure of 10700–13300 Pa at 60–65° C. for 16 hours, leaking out a small amount of nitrogen gas, to obtain polyacrylic acid in the form of white powder. It was found to have a weight-average molecular weight of 38,000 according to the GPC condition ②.

Example 1

First step: A mixture solution consisting of 60 g of the nonionic surfactant (1) shown in Table 1, 30 g of the water-soluble organic solvent (1), 10 g of the water-soluble organic solvent (2) and 12 g of ion-exchanged water was heated to 50° C. 4 g of the synthetic polymer (2) was dissolved in the solution over 5 hours to obtain a liquid dispersion medium.

Second step: 30 g of zeolite (1) and 10 g of sodium carbonate were suspended in 60 g of the liquid dispersion medium obtained in the first step. The suspension was subjected to wet grinding performed using a batchwise sand mill (manufactured by Imex Co, Ltd.) having a capacity of 1 L and filled with 800 g of 0.8 mm in diameter zirconia beads at a disk rotation speed of 1500 r/min for one hour. Thereafter, ground mixture was allowed to pass through 40 mesh screen to remove media, thereby obtaining a liquid detergent composition. A part of the liquid detergent composition was collected and diluted with ethanol to measure the particle diameter by using a size distribution measuring device (LA-910, manufactured by Horiba, Ltd., relative refractive index: 1.2 at 20° C.) to find that the average particle diameter was 0.8 μm.

Third step: A trace amount of a perfume was added to the dispersion obtained in the second step and the resulting dispersion was sufficiently stirred at ambient temperature to dissolve the perfume, thereby obtaining a liquid detergent composition.

Examples 2 to 9 and Comparative Examples 1 to 4

Using the components shown in Table 1, the first step, the second step and further, the third step were carried out in the same manner as in Example 1 to manufacture various liquid detergent compositions. In a part of these examples, the third step was carried out in the same manner as in Example 10 to be explained later.

Example 10

First step: 30 g of the nonionic surfactant (1) shown in Table 1, 30 g of the nonionic surfactant (2), 25 g of the water-soluble organic solvent (1), 10 g of the water-soluble organic solvent (2), 11 g of ion-exchanged water and 4 g of the synthetic polymer (8) were mixed to obtain a liquid dispersion medium.

Second step: 25 g of zeolite (2) and 15 g of crystalline silicate compound were suspended in 55 g of the liquid dispersion medium obtained in the first step. The suspension was subjected to wet grinding performed using a batchwise sand mill (manufactured by Imex Co., Ltd.) having a capacity of 1 L and filled with 800 g of 0.8 mm in diameter zirconia beads at a disk rotation speed of 1500 r/min for 7 hours. Thereafter, ground mixture was allowed to pass through 40 mesh screen to remove the media, thereby obtaining a dispersion. A part of the dispersion was collected and diluted with ethanol to measure the particle diameter by using a size distribution measuring device (LA-910, manufactured by Horiba, Ltd., relative refractive index: 1.2 at 20° C.) to find that the average particle diameter was 0.9 μm.

Third step: To the dispersion obtained in the second step were added 2.0 g of a bleaching activator represented by the formula (11) and a trace amount of a perfume and the mixture was sufficiently stirred at ambient temperature to dissolve. Further 2.0 g of sodium percarbonate, 0.5 g of the enzyme (1) and 0.5 g of the enzyme (2) were added to the resulting dispersion and the resulting mixture was sufficiently stirred at ambient temperature to disperse these components, thereby obtaining a liquid detergent composition.

(11)

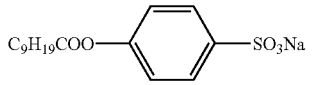

The volumetric separation rate and viscosity of the liquid detergent compositions obtained in Examples 1 to 10 and Comparative Examples 1 to 4 were measured and each detergent composition was subjected to a detergency test in the following manner. The results are shown in Table 1.

(1) Volumetric Separation Rate

Each liquid detergent composition was filled in a measuring cylinder made of glass such that it attained a depth of 30 cm and the cylinder was hermetically sealed. Each sample was stored statically at 25° C. for one month in a room. The boundary between the transparent liquid phase and solid dispersed phase of the sample after the sample was stored was determined visually to measure the thickness× (cm) of the transparent liquid phase which appeared on the upper portion by phase separation. The volumetric separation rate y (%) was calculated by the following formula (V).

$$y=(x/30)\times 100 \quad (V)$$

(2) Viscosity

A 200 mL beaker was filled with 200 g of the liquid detergent composition and subjected to measurement using a B-type viscometer manufactured by Tokyo Keiki in the condition of No. 2 or No. 3 rotor rotated at 6 to 60 r/min (25° C.)corresponding to the viscosity of the composition.

(3) Detergency Test 100 g of a mixture of 15 mass % of carbon black, 60 mass % of cotton seed oil, 5 mass % of cholesterol, 5 mass % of oleic acid, 5 mass % of palmitic acid and 10 mass % of liquid paraffin was dissolved and dispersed in 8 L of parklen. Cotton white cloth (unbleached muslin 2003 cloth) cut into a size of 10 cm×10 cm was dipped in the solution to soil the cloth and then parklen was removed by drying to prepare a soiled cloth with sebum/carbon soil (artificially soiled cloth).

Five of the above cloth soiled with sebum/carbon soil were collected as one group, which was soaked in 1 L of an aqueous detergent solution for evaluation to carry out the detergency test using a Targotometer in the following condition.

Washing time: 10 minutes

Detergent composition: 0.8 g/l L of aqueous detergent solution for evaluation

Hardness of water: 71.2 mg $CaCO_3$/L

Temperature of water: 20° C.

Rotations of the Targotometer: 100 r/min

Rinsing: rinsed for 5 minutes using 20° C. (tap)city water.

As to the detergency, each reflectance of the original cloth before soiled and the soiled cloth before and after washed was measured using an automatic calorimeter (manufactured by Shimadzu Corporation) at a wavelength of 550 nm to calculate the detergency (%) based on the following formula.

$$\text{Detergency (\%)}=\{(\text{Reflectance after washing}-\text{Reflectance before washing})/(\text{Reflectance of original cloth}-\text{Reflectance before washing})\}\times 100$$

TABLE 1

| | Example | | | | | | |
|---|---|---|---|---|---|---|---|
| Liquid detergent composition | 1 | 2 | 3 | 4 | 5 | 6 | 7 |
| Compounding components (mass %) | | | | | | | |
| Compounding components in the first step | | | | | | | |
| Nonionic surfactant(1) | 30.9 | 30.5 | 30 | 30 | 30 | 30 | |
| Nonionic surfactant(2) | | | | | | | 30 |
| Anionic surfactant | | 1 | | 0.5 | 1 | | |
| Water-soluble organic solvent(1) | 15.5 | 15.5 | 15 | 15 | | 15 | 15 |
| Water-soluble organic solvent(2) | 5.2 | 5 | 5 | 5 | 5 | 5 | 5 |
| Synthetic polymer(1) | | 2 | | | | | |
| Synthetic polymer(2) | 2.1 | | | | | | |
| Synthetic polymer(3) | | | | 2.1 | | | |
| Synthetic polymer(4) solution | | | | | 17 | | |
| Synthetic polymer(5) | | | | | | 2 | |
| Synthetic polymer(6) | | | | | | | 2 |
| Synthetic polymer(7) | | | | | | | |
| Synthetic polymer(8) | | | | | | | |
| Synthetic polymer(9) | | | 2 | | | | |
| Polymer(1) | | | | | | | |
| Polymer(2) | | | | | | | |
| Ion exchanged water | 6.3 | 6 | 3 | 6.4 | 6.4 | 2 | 6.4 |
| Compounding components in the second step | | | | | | | |
| Crystalline silicate compound | | | | | | | |
| zeolite(1) | 30 | 30 | | 30 | 30 | | 30 |
| zeolite(2) | | | 30 | | | 30 | |
| Sodium carbonate | 10 | 10 | 10 | 10 | 10 | 10 | 10 |
| Sodium citrate | | | | | | 1 | |
| Compounding components in the third step | | | | | | | |
| Sodium percarbonate | | | 2 | | | 2 | |
| Bleaching activator | | | 2 | | | 3 | |
| Enzyme(1) | | | 1 | | 0.6 | | 0.6 |
| Enzyme(2) | | | | 1 | | | 1 |
| Perfume * | trace amount | trace amount | trace amount | trace amount | trace amount | trace amount | trace amount |
| Volumetric separation rate (%) | 1 | 3 | 1 | 2 | 1 | 4 | 1 |
| Viscosity (mPa · s/25° C.) | 250 | 900 | 280 | 350 | 300 | 600 | 290 |
| Detergency (%) | 76 | 70 | 75 | 71 | 71 | 70 | 78 |

TABLE 1-continued

| | Example | | | Comparative example | | | |
|---|---|---|---|---|---|---|---|
| Liquid detergent composition | 8 | 9 | 10 | 1 | 2 | 3 | 4 |
| Compounding components (mass %) | | | | | | | |
| Compounding components in the first step | | | | | | | |
| Nonionic surfactant(1) | 20 | 10 | 15 | 30 | 31 | 30 | |
| Nonionic surfactant(2) | 10 | 20 | 15 | | | | 30 |
| Anionic surfactant | 1 | | | 1 | | | |
| Water-soluble organic solvent(1) | 12.5 | 12.5 | 12.5 | 15 | 15.5 | 15 | 15 |
| Water-soluble organic solvent(2) | 5 | 5 | 5 | 5 | 5.5 | 5 | 5 |
| Synthetic polymer(1) | | | | | | | |
| Synthetic polymer(2) | 2 | | | | | | |
| Synthetic polymer(3) | | | | | | | |
| Synthetic polymer(4) solution | | | | | | | |
| Synthetic polymer(5) | | | | | | | |
| Synthetic polymer(6) | | | | | | | |
| Synthetic polymer(7) | | 2 | | | | | |
| Synthetic polymer(8) | | | 2 | | | | |
| Synthetic polymer(9) | | | | | | | |
| Polymer(1) | | | | 2 | | | |
| Polymer(2) | | | | | | 2 | 2 |
| Ion exchanged water | 5.5 | 5.5 | 5.5 | 6 | 6 | 6 | 3 |
| Compounding components in the second step | | | | | | | |
| Crystalline silicate compound | 10 | 10 | 15 | | | | 10 |
| zeolite(1) | | | | 30 | 30 | 30 | |
| zeolite(2) | 25 | 25 | 25 | | | | 28 |
| Sodium carbonate | 5 | 5 | | 10 | 10 | 10 | |
| Sodium citrate | | | | 1 | 1 | 1 | 2 |
| Compounding components in the third step | | | | | | | |
| Sodium percarbonate | 2 | 1.5 | 2 | | | | 1.5 |
| Bleaching activator | 2 | 2 | 2 | | | | 1.5 |
| Enzyme(1) | | 0.5 | 0.5 | | 1 | 1 | 1 |
| Enzyme(2) | | 1 | 0.5 | | | | 1 |
| Perfume * | trace amount | trace amount | trace amount | trace amount | trace amount | trace amount | trace amount |
| Volumetric separation rate (%) | 2 | 1 | 1 | 8 | 1 | 53 | 37 |
| Viscosity (mPa · s/25° C.) | 240 | 330 | 300 | 5,000 | 10,500 | 2,000 | 3,000 |
| Detergency (%) | 71 | 72 | 72 | 69 | 67 | 74 | 78 |

* The amount of perfume is not taken into account in the amount of the composition.
* Nonionic surfactant (1): Emulgen 108 (manufactured by kao Corporation)
* Nonionic surfactant (2): Emulgen LS-106 (manufactured by Kao Corporation)
* Water-soluble organic solvent (1): Polyoxyethylene phenyl ether (PHG-30, manufactured by Nippon Nyukazai co., Ltd.)
* Water-soluble organic solvent (2): Propylene glycol
* Anionic surfactant: Straight-chain sodium alkylbenzenesulfonate having 10 to 14 carbon atoms of alkyl group
* Synthetic polymer (1): Polymer synthesized in Synthetic Example 1
* Synthetic polymer (2): Polymer synthesized in Synthetic Example 2
* Synthetic polymer (3): Polymer synthesized in Synthetic Example 3
* Synthetic polymer solution (4): Polymer solution (concentration: 11.8%) synthesized in Synthetic Example 4
* Synthetic polymer (5): Polymer synthesized in Synthetic Example 5
* Synthetic polymer (6): Polymer synthesized in Synthetic Example 6
* Synthetic polymer (7): Polymer synthesized in Synthetic Example 7
* Synthetic polymer (8): Polymer synthesized in Synthetic Example 8
* Synthetic polymer (9): Polymer synthesized in Synthetic Example 9
* Polymer (1): Polyethylene glycol (Polyethylene Glycol 2,000, manufactured by Wako Pure Chemical Industries, Ltd.)
* Polymer (2): Sodium polymethacrylate (weight average molecular weight: 9,500, manufactured by Aldrich Corporation)
* Sodium percarbonate: Average particle diameter: 16 μm, dispersed in the liquid prepared in the first step and measured using LA-910 manufactured by Horiba, Ltd., relative refractive index: 1.2
* Bleaching activator: Bleaching activator represented by the aforementioned formula (11)
* Crystalline silicate compound: Crystalline silicate compound described in Example 1 of the publication of JP-A No. 5-184946
* Zeolite (1): Toyobuilder (manufactured by Toyo Soda Manufacturing Co., Ltd.)
* Zeolite (2): Obtained by baking Toyobuilder (manufactured by Toyo Soda Manufacturing Co., Ltd.) at 450° C. for one hour to carry out dehydration
* Enzyme (1): Ebarase 16.0 L-EX (protease, manufactured by Novo Nordisk A/S)
* Enzyme (2): Liporase 100 L (lipase, manufactured by Novo Nordisk A/S)

Nonionic surfactant (1): Emulgen 108 (manufactured by Kao Corporation)

Nonionic surfactant (2): Emulgen LS-106 (manufactured by Kao Corporation)

Water-soluble organic solvent (1): Polyoxyethylene phenyl ether (PHG-30, manufactured by Nippon Nyukazai Co., Ltd.)

Water-soluble organic solvent (2): Propylene glycol

Anionic surfactant: Straight-chain sodium alkylbenzenesulfonate having 10 to 14 carbon atoms of alkyl group Synthetic polymer (1): Polymer synthesized in Synthetic Example 1

Synthetic polymer (2): Polymer synthesized in Synthetic Example 2

Synthetic polymer (3): Polymer synthesized in Synthetic Example 3

Synthetic polymer solution (4): Polymer solution (concentration: 11.8%) synthesized in Synthetic Example 4

Synthetic polymer (5): Polymer synthesized in Synthetic Example 5

Synthetic polymer (6): Polymer synthesized in Synthetic Example 6

Synthetic polymer (7): Polymer synthesized in Synthetic Example 7

Synthetic polymer (8): Polymer synthesized in Synthetic Example 8

Synthetic polymer (9): Polymer synthesized in Synthetic Example 9

Polymer (1): Polyethylene glycol (Polyethylene Glycol 2,000, manufactured by Wako Pure Chemical Industries, Ltd.)

Polymer (2): Sodium polymethacrylate (weight average molecular weight: 9,500, manufactured by Aldrich Corporation)

Sodium percarbonate: Average particle diameter: 16 μm, dispersed in the liquid prepared in the first step and measured using LA-910 manufactured by Horiba, Ltd., relative refractive index: 1.2

Bleaching activator: Bleaching activator represented by the aforementioned formula (11)

Crystalline silicate compound: Crystalline silicate compound described in Example 1 of the publication of JP-A No. 5-184946

Zeolite (1): Toyobuilder (manufactured by Toyo Soda Manufacturing Co., Ltd.)

Zeolite (2): Obtained by baking Toyobuilder (manufactured by Toyo Soda Manufacturing Co., Ltd.) at 450° C. for one hour to carry out dehydration Enzyme (1): Ebarase 16.0 L-EX (protease, manufactured by Novo Nordisk A/S)

Enzyme (2): Liporase 100 L (lipase, manufactured by Novo Nordisk A/S)

It has been found from Table 1 that since the liquid detergent composition of the present invention uses the component (b), the solid dispersoid mixture containing the component (a) can be stably dispersed to thereby decrease the volumetric separation rate after one month to 5% or less and the detergent composition has excellent detergency.

Example 11

First step: 2 g of the synthetic polymer (5) was dissolved in 100 g of ethanol, to which were added 30 g of zeolite (1) and 10 g of sodium carbonate and the mixture was stirred for 3 hours to obtain a dispersion. The resulting dispersion was raised to 60° C. and then dried under reduced pressure to distill ethanol completely, thereby obtaining a polymer-coated inorganic powder.

Second step: 60 g of the nonionic surfactant (1), 30 g of the water-soluble organic solvent (1), 10 g of the water-soluble organic solvent (2) and 12 g of ion-exchanged water were mixed to obtain a liquid dispersion medium.

Third step: 42 g of the polymer-coated inorganic powder obtained in the first step was suspended in 60 g of the liquid dispersion medium obtained in the second step. The suspension was subjected to wet grinding performed using a batchwise sand mill (manufactured by I.mecs) having a capacity of 1 L and filled with 800 g of 0.8-mm-diameter zirconia beads at a disk rotation speed of 1500 r/min for one hour. Thereafter, ground mixture was allowed to pass through 40 mesh screen to remove the media, thereby obtaining a liquid detergent composition.

A part of the liquid detergent composition was collected and diluted with ethanol to measure the particle diameter by using a size distribution measuring device (LA-910, manufactured by Horiba, Ltd., relative refractive index: 1.2 at 20° C.) to find that the average particle diameter was 0.6 μm. Also, the resulting liquid detergent composition had a viscosity (25° C.) as low as 320 mPa·s, exhibited high detergency and had high dispersion stability.

Example 12~19, Comparative Example 5~10

The components shown in Table 2 were mixed and wet ground according to the below described steps and liquid detergents were prepared. The comparative example contained no polymer of the invention.

First step: The given amounts of the components shown in Table 2 were mixed and stirred for 30 minutes at a room temperature. The polymer was used in the form of the solution obtained in Example and supplemental amounts of the water-soluble solvent and ion-exchanged water were added to obtain the given amounts in addition to those accompanied by the solid polymer.

Second step: The components shown in Table 2 were added to the solution obtained in the previous step and the mixture were kneaded with a stainless steel rod. It was transferred to a batchwise sand mill, manufactured by Imex Co., Ltd., having 1 liter of capacity filled with 800 g of zirconia beads having a diameter of 0.8 mm and wet ground with a disk rotating at 1500 r/min for 1 hour. It was separated from media with a sieve of 40 mesh at the room temperature to obtain a white dispersion liquid. A part of the product was diluted with ethanol, and the particle size was measured with a size distribution measuring device (LA-910, manufactured by Horiba, Ltd., relative refractive index: 1.2 at 20° C.) to find that the average particle diameter was 0.8–0.4 μm.

Example 18 and 19 were carried out without removal of media, proceeding after wet grinding to the subsequent step.

Third step: In Example 18 and 19, the rotation of the disk was adjusted at 800 r/min just after the last step and the components shown in Table 2 were added thereto, stirred for 10 minutes, then cooled down to the room temperature. The media were removed out with a sieve of 40 mesh to obtain a white dispersion. Taking a part of the product, the particle size was measured in the same way as above to find that the average particle diameter was 0.6–0.4 μm.

Fourth step: The obtained dispersion was stirred at the room temperature and the components shown in Table 2 were added thereto, stirred for 30 minutes, to obtain given liquid detergents. The obtained liquid detergents were determined in view of a volumetric separation rate, viscosity and detergent test (detergency) in the same manners as shown above. Results are shown in Table 2.

Nonionic surfactant (1): Emulgen 108 (manufactured by Kao Corporation)

Nonionic surfactant (2): Emulgen LS-106 (manufactured by Kao Corporation)

Anionic surfactant: sodium straight alkylbenzene sulfonate having 10 to 14 carbon atoms in the alkyl Water-soluble organic solvent (1): Propylene glycol Water-soluble organic solvent (2): triethylene glycol monophenyl ether (PHG-30, manufactured by Nippon Nyukazai Co., Ltd.)

Water-soluble organic solvent (3): diethylene glycol monobutyl ether

Synthetic polymer (10): Polymer synthesized in Synthetic Example 10

Synthetic polymer (11): Polymer synthesized in Synthetic Example 11

Synthetic polymer (12): Polymer synthesized in Synthetic Example 12

Synthetic polymer (13): Polymer synthesized in Synthetic Example 13

Synthetic polymer (14): Polymer synthesized in Synthetic Example 14

Crystalline silicate compound: Crystalline silicate compound described in Example 1 of JP-A No. 5-184946

Aluminosilicate: zeolite, Toyobuilder (manufactured by Toyo Soda Manufacturing Co., Ltd.)

Polyacrylic acid: powder of polyacrylic acid obtained in Synthetic Example 15

Enzyme(1)Ebarase 16. OL-EX (protease, manufactured by Novo Nordisk A/S)

Enzyme(2)Liporase 100 L (lipase, manufactured by Novo Nordisk A/S)

TABLE 2

| | Example | | | | | | |
|---|---|---|---|---|---|---|---|
| | 12 | 13 | 14 | 15 | 16 | 17 | 18 |
| Compounding components (mass %) | | | | | | | |
| Compounding components in the first step | | | | | | | |
| Nonionic surfactant (1) | 30.2 | 30.2 | 15.1 | 15.1 | 15.1 | 9.9 | 10 |
| Nonionic surfactant (2) | 0 | 0 | 13.1 | 15.1 | 14.1 | 9.9 | 0 |
| Anionic surfactant | 0 | 0 | 1 | 0 | 0 | 0 | 0 |
| Water-soluble organic solvent (1) | 5 | 5 | 5 | 5 | 5 | 5 | 5 |
| Water-soluble organic solvent (2) | 15.1 | 0 | 15.1 | 15.1 | 15.1 | 0 | 15.1 |
| Water-soluble organic solvent (3) | 0 | 15.1 | 0 | 0 | 0 | 25.5 | 0 |
| Synthetic polymer(10) | 3 | 0 | 0 | 0 | 0 | 3 | 3 |
| Synthetic polymer(11) | 0 | 3 | 0 | 0 | 0 | 0 | 0 |
| Synthetic polymer(12) | 0 | 0 | 4 | 0 | 0 | 0 | 0 |
| Synthetic polymer(13) | 0 | 0 | 0 | 3 | 0 | 0 | 0 |
| Synthetic polymer(14) | 0 | 0 | 0 | 0 | 4 | 0 | 0 |
| Ion exchanged water | 5.6 | 5.6 | 5.7 | 5.6 | 5.6 | 5.6 | 5.6 |
| Compounding components in the second | | | | | | | |
| Crystalline silicate compound | 12.5 | 12.5 | 0 | 0 | 0 | 0 | 12.5 |
| Aluminosilicate | 27.6 | 26.6 | 30 | 30 | 30 | 30 | 27.6 |
| Sodium carbonate | 0 | 0 | 10 | 11.1 | 11.1 | 11.1 | 0 |
| Sodium citrate | 1 | 1 | 0 | 0 | 0 | 0 | 1 |
| Polyacrylic acid | 0 | 0 | 0 | 0 | 0 | 0 | 0 |
| Compounding components in the third step | | | | | | | |
| Nonionic surfactant (1) | 0 | 0 | 0 | 0 | 0 | 0 | 20.2 |
| Nonionic surfactant (2) | 0 | 0 | 0 | 0 | 0 | 0 | 0 |
| Compounding components in the fourth step | | | | | | | |
| Enzyme (1) | 0 | 0.5 | 0.5 | 0 | 0 | 0 | 0 |
| Enzyme (2) | 0 | 0.5 | 0.5 | 0 | 0 | 0 | 0 |
| Perfume | trace amount | trace amount | trace amount | trace amount | trace amount | trace amount | trace amount |
| Total (exclude perfume) | 100 | 100 | 100 | 100 | 100 | 100 | 100 |
| viscosity (mPa · s) | 396 | 282 | 1800 | 270 | 1500 | 266 | 210 |
| Volumetric separation rate (%) | 1 | 1 | 0 | 1 | 0 | 1 | 1 |
| Detergency (%) | 74 | 75 | 75 | 73 | 74 | 73 | 73 |

TABLE 2-continued

| | Example | Comparative example | | | | | |
|---|---|---|---|---|---|---|---|
| | 19 | 5 | 6 | 7 | 8 | 9 | 10 |
| Compounding components (mass %) | | | | | | | |
| Compounding components in the first step | | | | | | | |
| Nonionic surfactant (1) | 5 | 30.2 | 30.2 | 15.1 | 15.1 | 15.1 | 9.9 |
| Nonionic surfactant (2) | 5 | 0 | 0 | 13.1 | 15.1 | 15.1 | 9.9 |
| Anionic surfactant | 0 | 0 | 0 | 1 | 0 | 0 | 0 |
| Water-soluble organic solvent (1) | 5 | 5 | 5 | 5 | 5 | 5 | 5 |
| Water-soluble organic solvent (2) | 15.1 | 15.1 | 0 | 15.1 | 0 | 15.1 | 0 |
| Water-soluble organic solvent (3) | 0 | 0 | 15.1 | 0 | 15.1 | 0 | 25.5 |
| Synthetic polymer(10) | 0 | 0 | 0 | 0 | 0 | 0 | 0 |
| Synthetic polymer(11) | 0 | 0 | 0 | 0 | 0 | 0 | 0 |
| Synthetic polymer(12) | 0 | 0 | 0 | 0 | 0 | 0 | 0 |
| Synthetic polymer(13) | 3 | 0 | 0 | 0 | 0 | 0 | 0 |
| Synthetic polymer(14) | 0 | 0 | 0 | 0 | 0 | 0 | 0 |
| Ion exchanged water | 5.6 | 5.6 | 5.6 | 5.7 | 5.6 | 5.6 | 5.6 |
| Compounding components in the second | | | | | | | |
| Crystalline silicate compound | 0 | 13.5 | 13.5 | 0 | 0 | 0 | 0 |
| Aluminosilicate | 28 | 29.6 | 28.6 | 32 | 32 | 32 | 32 |
| Sodium carbonate | 11.1 | 0 | 0 | 12 | 12.1 | 12.1 | 12.1 |
| Sodium citrate | 0 | 1 | 1 | 0 | 0 | 0 | 0 |
| Polyacrylic acid | 2 | 0 | 0 | 0 | 0 | 0 | 0 |
| Compounding components in the third step | | | | | | | |
| Nonionic surfactant (1) | 10.1 | 0 | 0 | 0 | 0 | 0 | 0 |
| Nonionic surfactant (2) | 10.1 | 0 | 0 | 0 | 0 | 0 | 0 |
| Compounding components in the fourth step | | | | | | | |
| Enzyme (1) | 0 | 0 | 0.5 | 0.5 | 0 | 0 | 0 |
| Enzyme (2) | 0 | 0 | 0.5 | 0.5 | 0 | 0 | 0 |
| Perfume | trace amount | trace amount | trace amount | trace amount | trace amount | trace amount | trace amount |
| Total (exclude perfume) | 100 | 100 | 100 | 100 | 100 | 100 | 100 |
| viscosity (mPa · s) | 127 | 16000 | 11000 | 17000 | 16000 | 15000 | 8900 |
| Volumetric separation rate (%) | 3 | 1 | 1 | 1 | 1 | 1 | 11 |
| Detergency (%) | 71 | 69 | 70 | 68 | 71 | 69 | 70 |

* The amount of perfume is not taken into account in the amount of the composition.
* Nonionic surfactant (1): Emulgen 108 (manufactured by kao Corporation)
* Nonionic surfactant (2): Emulgen LS-106 (manufactured by Kao Corporation)
* Anionic surfactant: sodium straight alkylbenzene sulfonate having 10 to 14 carbon atoms in the alkyl
* Water-soluble organic solvent (1): Propylene glycol
* Water-soluble organic solvent (2): triethylene glycol monophenyl ether (PHG-30, manufactured by Nippon Nyukazai co., Ltd.)
* Water-soluble organic solvent (3): diethylene glycol monobutyl ether
* Synthetic polymer (10): Polymer synthesized in Synthetic Example 10
* Synthetic polymer (11): Polymer synthesized in Synthetic Example 11
* Synthetic polymer (12): Polymer synthesized in Synthetic Example 12
* Synthetic polymer (13): Polymer synthesized in Synthetic Example 13
* Synthetic polymer (14): Polymer synthesized in Synthetic Example 14
* Crystalline silicate compound: Crystalline silicate compound described in Example 1 of JP-A No. 5-184946
* Aluminosilicate: zeolite, Toyobuilder (manufactured by Toyo Soda Manufacturing Co., Ltd.)
* Polyacrylic acid: powder of polyacrylic acid obtained in Synthetic Example 15
* Enzyme(1)Ebarase 16. OL-EX (protease, manufactured by Novo Nordisk A/S)
* Enzyme(2)Liporase 100 L (lipase, manufactured by Novo Nordisk A/S)

What is claimed is:

1. A liquid detergent composition comprising a liquid dispersion medium and a solid dispersoid, dispersed in the liquid dispersion medium, the composition having a viscosity (25° C.) of 3000 mPa·s or less and a volumetric separation rate (25° C., allowed to stand for 30 days) of 5% or less, wherein at least part of the solid dispersoid is particles of at least one inorganic builder (a) selected from the group consisting of an aluminosilicate compound, a crystalline silicate compound and a carbonate in an amount of 30 mass % or more per the composition and the liquid dispersion medium and/or the solid dispersoid contains a block or graft polymer (b) having (i) a carboxyl group or a salt thereof and (ii) a polymer chain having the constituting unit of an alkyleneoxy group;

wherein (b) is a copolymer of an ester of a polyalkylene glycol and a vinyl monomer having a carboxyl group and a vinyl monomer having a carboxyl group or a salt thereof, and wherein the ratio of water in the liquid dispersion medium is 5.5 to 20 mass %.

2. The liquid detergent composition according to claim 1, wherein (b) is a polymer excluding a hydrocarbon group having 4 or more carbon atoms.

3. The liquid detergent composition according to claim 1 or 2, wherein (b) is obtained by polymerizing a monomer in a solvent of at least one liquid constituting the liquid dispersion medium.

4. A liquid detergent composition comprising a liquid dispersion medium and a solid dispersoid dispersed in the liquid dispersion medium, the composition having a viscosity (25° C.) of 3000 mPa·s or less and volumetric separation rate (25° C., allowed to stand for 30 days) of 50% or less, wherein at least part of the solid dispersoid is particles of at least one inorganic builder (a) selected from the group consisting of an aluminosilicate compound, a crystalline silicate compound and a carbonate in an amount of 30 mass % or more per the composition, and the liquid dispersion medium and /or the solid dispersoid contains a block or graft polymer (b) having (i) a carboxyl group or a salt thereof and (ii) a polymer chain having the constituting unit of an alkyleneoxy group; wherein (b) is a copolymer of a polyalkylene glycol ether having a reactive unsaturated group and a vinyl monomer having a carboxyl group or a salt thereof, and wherein the ratio of water in the liquid dispersion medium is 5.5 to 20 mass %.

5. The liquid detergent composition according to any of claim 1, wherein (b) is a copolymer obtained by grafting a vinyl monomer having a carboxyl group or a salt thereof on a polyalkylene glycol.

6. The liquid detergent composition according to any one of claim 1, having a viscosity (25° C.) of 1000 mPa·s or less.

7. The liquid detergent composition according to any one of claim 1, wherein the aluminosilicate compound is at least one compound represented by the formula (1):

$$(M^1_pM^2_qM^3_rO)_u\cdot(M^4_sM^5_tO)_v\cdot(Al_2O_3)_w\cdot(SiO_2) \quad (1)$$

wherein $M^1$, $M^2$ and $M^3$ represent Na, K or H, $M^4$ and $M^5$ represent Ca or Mg, p, q and r denote a number of 0 to 2, provided that p+q+r=2, s and t denote a number of 0 to 1, provided that s+t=1, u denotes a number of 0 to 1, v denotes a number of 0 to 1 and w denotes a number of 0 to 0.6.

8. The liquid detergent composition according to any one of claim 1, wherein the crystalline silicate compound is at least one compound represented by the formula (2)

$$(M^1_pM^2_qM^3_rO)\cdot(M^4_sM^5_tO)_x\cdot(SiO_2)_y \quad (2)$$

wherein $M^1$, $M^2$, $M^3$, $M^4$, $M^5$, p, q, r, s and t are the same as defined in the formula (1), x represents a number of 0 to 1 and y represents a number of 0.9 to 3.5.

9. The liquid detergent composition according to any one of claim 1, wherein (a) is a sodium carbonate.

10. The liquid detergent composition according to any one of claim 1, wherein (a) has an average particle diameter of 2 μm or less.

11. A method for producing a liquid detergent composition as claimed in any one of claim 1, comprising bringing (a) into contact with (b) and then mixing (a) and (b) with the liquid dispersion medium.

12. A method for producing a liquid detergent composition as claimed in any one of claim 1, comprising wet grinding (a) and (b) in the wet state in the liquid medium.

13. The liquid detergent composition according to claim 1, wherein the ratio by mass of the polymer chain having the carboxyl group or a salt thereof (i) to the polymer chain (ii) having the constituting of an alkyleneoxy group is 5/95 to 95/5.

* * * * *